US010533465B2

(12) United States Patent
Jeon et al.

(10) Patent No.: US 10,533,465 B2
(45) Date of Patent: Jan. 14, 2020

(54) VARIABLE VALVE LIFT ACTUATOR OF ENGINE

(71) Applicant: MOTONIC CORPORATION, Seoul (KR)

(72) Inventors: Wan Jae Jeon, Daegu (KR); Soo Hyun Hwang, Daegu (KR); Jong Wung Park, Daegu (KR); Jun Min Park, Daegu (KR); Chan Wung Park, Daegu (KR); Dong Hyeong Lee, Daegu (KR)

(73) Assignee: MOTONIC CORPORATION, Seoul (KR)

( * ) Notice: Subject to any disclaimer, the term of this patent is extended or adjusted under 35 U.S.C. 154(b) by 0 days.

(21) Appl. No.: 16/056,714

(22) Filed: Aug. 7, 2018

(65) Prior Publication Data

US 2019/0048766 A1 Feb. 14, 2019

(30) Foreign Application Priority Data

Aug. 10, 2017 (KR) ..... 10-2017-0101443

(51) Int. Cl.
*F01L 1/18* (2006.01)
*F01L 13/00* (2006.01)
(Continued)

(52) U.S. Cl.
CPC ..... *F01L 13/0036* (2013.01); *F01L 1/047* (2013.01); *F01L 1/185* (2013.01); *F01L 1/2405* (2013.01); *F01L 2001/186* (2013.01)

(58) Field of Classification Search
CPC ... F01L 1/053; F01L 2001/186; F01L 1/2405; F01L 1/267; F01L 1/46; F01L 2001/467;
(Continued)

(56) References Cited

U.S. PATENT DOCUMENTS 4,203,397 A * 5/1980 Soeters, Jr. ..... F01L 1/2405 123/198 F
4,762,096 A * 8/1988 Kamm ..... F01L 13/0026 123/198 F
(Continued)

FOREIGN PATENT DOCUMENTS

KR 10-1675511 B1 11/2016
KR 1020170005567 A 1/2017
(Continued)

*Primary Examiner* — Jorge L Leon, Jr.
(74) *Attorney, Agent, or Firm* — Novick, Kim & Lee, PLLC; Jae Youn Kim

(57) ABSTRACT

A variable valve lift actuator of an engine includes a first body that rotates within a predetermined angular range; a second body connected to or disconnected from the first body; a latching pin configured to project to or retract from the first body by passing through the second body to connect or disconnect the first body and the second body; a drive module connected to the latching pin through a connecting member to project or retract the latching pin; a rotary shaft disposed above the valve across both side walls of the first body and the second body such that the first body is rotatable; and a return spring installed on the rotary shaft to provide a restoring force to return the first body rotated by the high-speed cam to an original position thereof.

9 Claims, 8 Drawing Sheets

(51) Int. Cl.
*F01L 1/047* (2006.01)
*F01L 1/24* (2006.01)

(58) Field of Classification Search
CPC ..... F01L 13/0005; F01L 2013/001; F01L 2013/101; F01L 2101/00; F01L 2105/00; F01L 2820/031
USPC ..... 123/90.15, 90.16, 90.2, 90.4, 90.41, 123/90.43, 90.44, 90.46
See application file for complete search history.

(56) References Cited

U.S. PATENT DOCUMENTS 5,544,626 A * 8/1996 Diggs ..... F01L 1/185 123/198 F
5,623,897 A * 4/1997 Hampton ..... F01L 1/185 123/198 F
5,653,198 A * 8/1997 Diggs ..... F01L 1/185 123/198 F
5,697,333 A * 12/1997 Church ..... F01L 13/0005 123/198 F
6,499,451 B1 * 12/2002 Hendriksma ..... F01L 1/08 123/198 F
2003/0111031 A1 * 6/2003 Hendricksma ..... F01L 1/18 123/90.15
2011/0303174 A1 * 12/2011 Ezaki ..... F01L 1/185 123/90.46
2012/0006291 A1 * 1/2012 Nishikiori ..... F02D 13/08 123/90.15

FOREIGN PATENT DOCUMENTS

KR 10-1716321 B1 3/2017
KR 10-1736806 B1 5/2017
WO WO-2013171392 A1 * 11/2013 ..... F01L 1/181

* cited by examiner

VARIABLE VALVE LIFT ACTUATOR OF ENGINE

CROSS-REFERENCE TO RELATED APPLICATIONS

This application claims priority to and benefit of KR 10-2017-0101443 filed Aug. 10, 2017, and the disclosure of which is incorporated by reference herein in its entirety.

BACKGROUND OF THE INVENTION

1. Field of the Invention

The present invention relates to a variable valve lift actuator of an engine, and more particularly, to a variable valve lift actuator of an engine that controls a lift amount of a valve in accordance with an operating condition of a vehicle.

2. Description of the Related Art

A valve mechanism applied to an engine of a vehicle supplies a mixed gas to a combustion chamber and discharges a combustion gas according to the stroke of the engine.

Recently, variable valve mechanisms have been developed and applied to an engine to optimize a flow rate of a mixed gas and a discharge efficiency of a combustion gas by varying an opening degree or an opening/closing timing of a valve according to the operating conditions of the engine, that is, according to operating areas of the engine which are defined depending on the rotational speed and load of the engine.

Accordingly, the variable valve mechanisms for an engine of a vehicle can improve the engine performance such as the fuel efficiency, torque, and output of the engine and reduce the amount of exhaust gas.

Such a variable valve mechanism for an engine of a vehicle includes a variable valve timing mechanism for varying the opening and closing timing of the valve, a variable valve lift mechanism for varying the opening degree of the valve, and a variable valve operating angle mechanism for changing an operating angle of the valve.

Among them, the variable valve lift mechanism is for improving the output and fuel efficiency in a medium-low speed mode, and is classified into a rocker arm type, a pivot type, a tappet type, and a bucket type.

Meanwhile, according to the variable valve lift mechanism of a related art, the displacement of an intake valve is always constant regardless of the load of the vehicle, so that the engine speed for achieving an optimum efficiency may be limited. In the case of a low-speed and low-load mode, there is a problem that the combustion is unstable due to the backflow of the exhaust gas so that the fuel efficiency of the vehicle is lowered.

For this reason, there is an attempt to use hydraulic pressure for the pause of the valve, but the structure of the variable valve lift mechanism becomes complicated, and the workability is lowered.

Further, in the case of using the hydraulic pressure, the viscosity of operating oil is sensitive to the temperature so that operating pressure is changed, resulting in the malfunction of the variable valve lift mechanism and inaccuracy in adjusting the lift amount of the valve.

In order to solve such a problem, as disclosed below in patent documents 1 to 3 which are now patent-registered, the applicant of the present invention has proposed a variable valve lift technology for improving the engine efficiency by performing an idle control operation, in which some cylinders are deactivated in a low-speed and low-load state of an engine and all cylinders are activated in a high-speed and high-load state of the engine, and a two-stage variable control operation for a high-speed mode and a low-speed mode.

RELATED ART DOCUMENTS

Patent Documents (Patent Document 1) Korean Patent Registration No. 10-1736806 (issued on May 22, 2017)

(Patent Document 2) Korean Patent Registration No. 10-1675511 (issued on Nov. 22, 2016)

(Patent Document 3) Korean Patent Registration No. 10-1716321 (issued on Mar. 17, 2017)

Patent Documents 1 to 3 include a latching pin for connecting or disconnecting a first body and a second body, and a drive module installed at a rear of the latching pin to project and retract a latching module.

As a result, Patent documents 1 to 3 require a separate space for installing the drive module, which is installed at the rear of the first and second bodies, on a cylinder head, so Patent documents 1 to 3 do not completely solve the limitation in the structure of the cylinder head.

SUMMARY OF THE INVENTION

The present invention has been made to solve the above problem occurring in the related art and an object of the present invention is to provide a variable valve lift actuator of an engine that controls a lift amount of a valve in accordance with an operating condition of a vehicle.

Another object of the present invention is to provide a variable valve lift actuator of an engine, capable of deactivating some cylinders in a low-speed and low-load state of a vehicle.

It is still another object of the present invention to provide a variable valve lift actuator of an engine, which can solve the limitation in the structure of a cylinder head when a vehicle is mounted and improve the operating performance of a valve.

In order to achieve the above objects, the present invention provides a variable valve lift actuator of an engine, the variable valve lift actuator including: a first body that rotates within a predetermined angular range by a rotational movement of a high-speed cam coupled to a camshaft; a second body connected to or disconnected from the first body, rotated by the rotational movement of the high-speed cam when connected to the first body, and rotated by a rotational movement of a low-speed cam provided at both sides of the high-speed cam when disconnected from the first body, thereby adjusting a lift amount of a valve; a latching pin configured to project to or retract from the first body by passing through the second body to connect or disconnect the first body and the second body; a drive module connected to the latching pin through a connecting member to project or retract the latching pin; a rotary shaft disposed above the valve across both side walls of the first body and the second body such that the first body is rotatable; and a return spring installed on the rotary shaft to provide a restoring force to return the first body rotated by the high-speed cam to an original position thereof, wherein a lift amount of a valve is variably controlled in two stages of a high-speed mode and a low-speed mode according to operating conditions of the engine, an idle control operation of the valve, in which cylinders are deactivated by operating the latching pin to disconnect the first body and the second body in a low-speed and low-load state of the engine, is performed when the high-speed cam is only installed on the camshaft, the drive module is installed on a cylinder head of the vehicle, and the connecting member is provided between the drive pin of the drive module and the latching pin to transmit a driving force of the drive pin to the latching pin.

As described above, according to the variable valve lift actuator of the engine of the present invention, the idle control operation of the valve, in which some cylinders are deactivated, and a two-stage variable control operation of a high-speed mode and a low-speed mode can be performed according to operating conditions of the engine.

That is, according to the present invention, the opening and closing operation of the valve and the idle control operation of the valve can be implemented by selectively connecting or disconnecting the first body and the second body by using the latching pin, thereby deactivating some cylinders in the low-speed and low-load state of the engine.

Thus, according to the present invention, it is possible to minimize the amount of fuel consumption in the low-speed and low-load state of the engine, thereby improving the efficiency of the engine and maximizing the fuel efficiency of the vehicle.

According to the present invention, the connecting member is applied between the drive pin of the drive module and the latching pin to project or retract the latching pin to connect or disconnect the first and second bodies, thereby improving the dynamic characteristics and operating performance of the valve.

Further, according to the present invention, since the drive module is provided on the cylinder head, the mounting space can be minimized when mounted on the cylinder head, thereby minimizing the restriction in the structure of the cylinder head.

In addition, according to the present invention, since the return spring for returning the first body to its original position is provided inside the first body, it is possible to eliminate the head machining work of the first body which is required in the related art where a compression spring is provided in contact with a lower portion of the first body.

Thus, according to the present invention, it is possible to improve the workability by eliminating the head machining work of the first body, which is required in the related art due to the application of the compression spring, and to simplify the structure of the variable valve lift actuator of the engine, so that the present invention can be easily applied to an actual engine of the vehicle.

Further, according to the present invention, the pivot point serving as the rotational center of the first body is moved toward the valve side to reduce the weight and the moment of inertia, so that the dynamic characteristics and workability of the valve can be improved.

According to the present invention, semi-cylindrical pressing pieces may be formed on both sides of the second body, or openings may be formed on both sides of the second body, and contact surfaces are formed at both ends of the first rotary shaft such that an upper end of the valve makes contact with the pressing pieces or the contact surfaces. Thus, the contact area can be increased, thereby improving the operational characteristics of the valve.

Further, according to the present invention, it is possible to minimize the length of the rotary shaft coupled to the first and second bodies, thereby reducing the weight of the product and improving the operating characteristics of the valve.

In addition, according to the present invention, it is possible to implement the two-stage control operation and the idle control operation of the valve according to the configuration of the cam by using the same variable valve lift actuator.

Further, according to the present invention, since the roller rocker arm and the second body are integrally manufactured in the swing arm type structure instead of the conventional direct-drive type structure, cost reduction can be realized, and an effect of reinforcing the rigidity and facilitating the latching property can be obtained by changing the shape of the front wall of the second body.

As a result, according to the present invention, it is possible to solve the problem of lowering the workability due to the process for forming an oil passage while solving the limitation in the oil temperature (viscosity) in the cylinder pause mechanism using the hydraulic pressure and the two-stage variable valve lift mechanism.

DETAILED DESCRIPTION OF THE INVENTION

Hereinafter, a variable valve lift actuator of an engine according to a preferred embodiment of the present invention will be described in detail with reference to the accompanying drawings.

The variable valve lift actuator of an engine according to the present invention is configured to perform an idle control operation for activating or deactivating cylinders according to driving conditions of a vehicle and a two-stage variable control operation for controlling a lift amount of a valve in two stages of a high-speed mode and a low-speed mode.

In the present specification, the configuration for implementing the idle control operation of the valve will be described as a first embodiment, and the configuration for performing the variable control operation of the valve in two stages based on the configuration of the first embodiment will be described as a second embodiment.

To this end, a camshaft of the engine is provided with one cam when the idle control operation of the valve is implemented, and a high-speed cam and low-speed cams installed on both sides of the high-speed cam are provided when the two-stage variable control operation of the valve is implemented.

Embodiment 1

Figure 1:
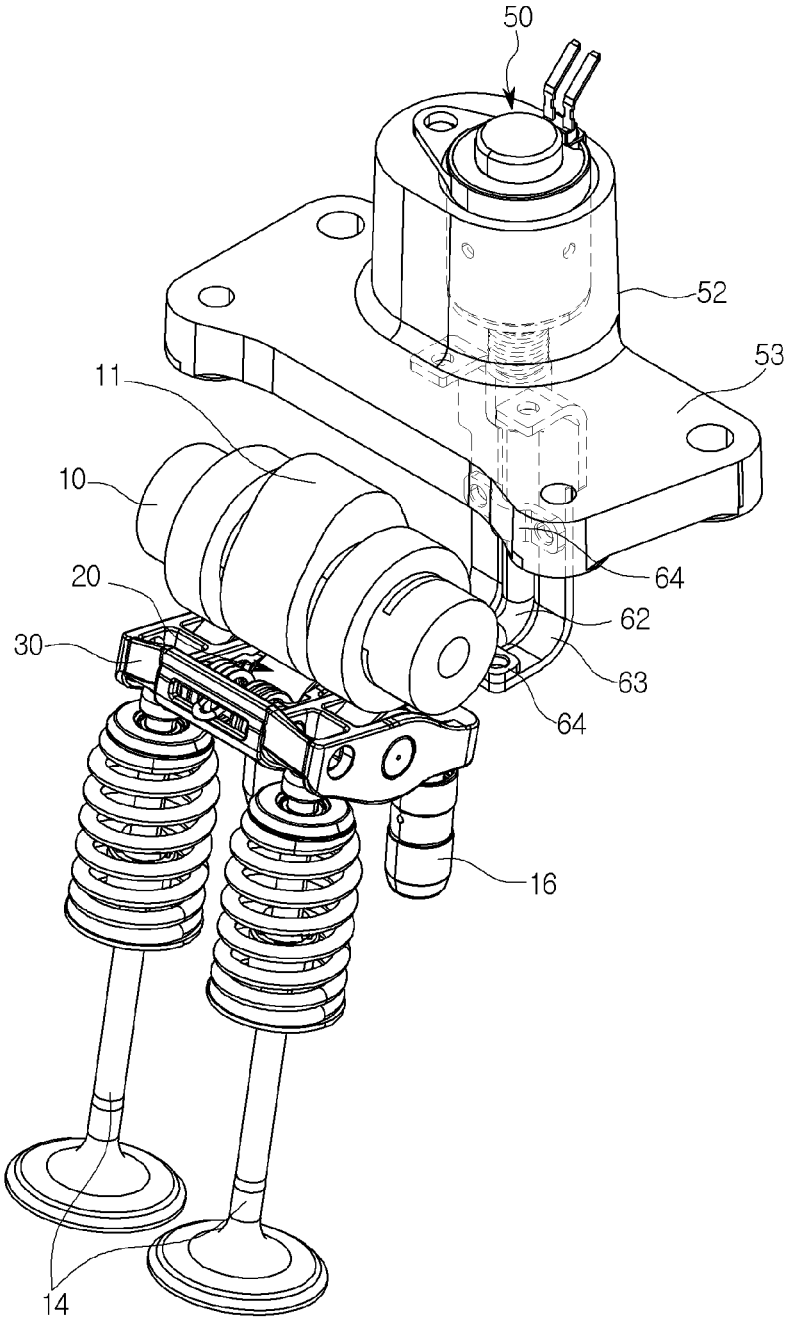
FIG. 1 is a perspective view of a variable valve lift actuator of an engine according to a first embodiment of the present invention.
Figure 2:
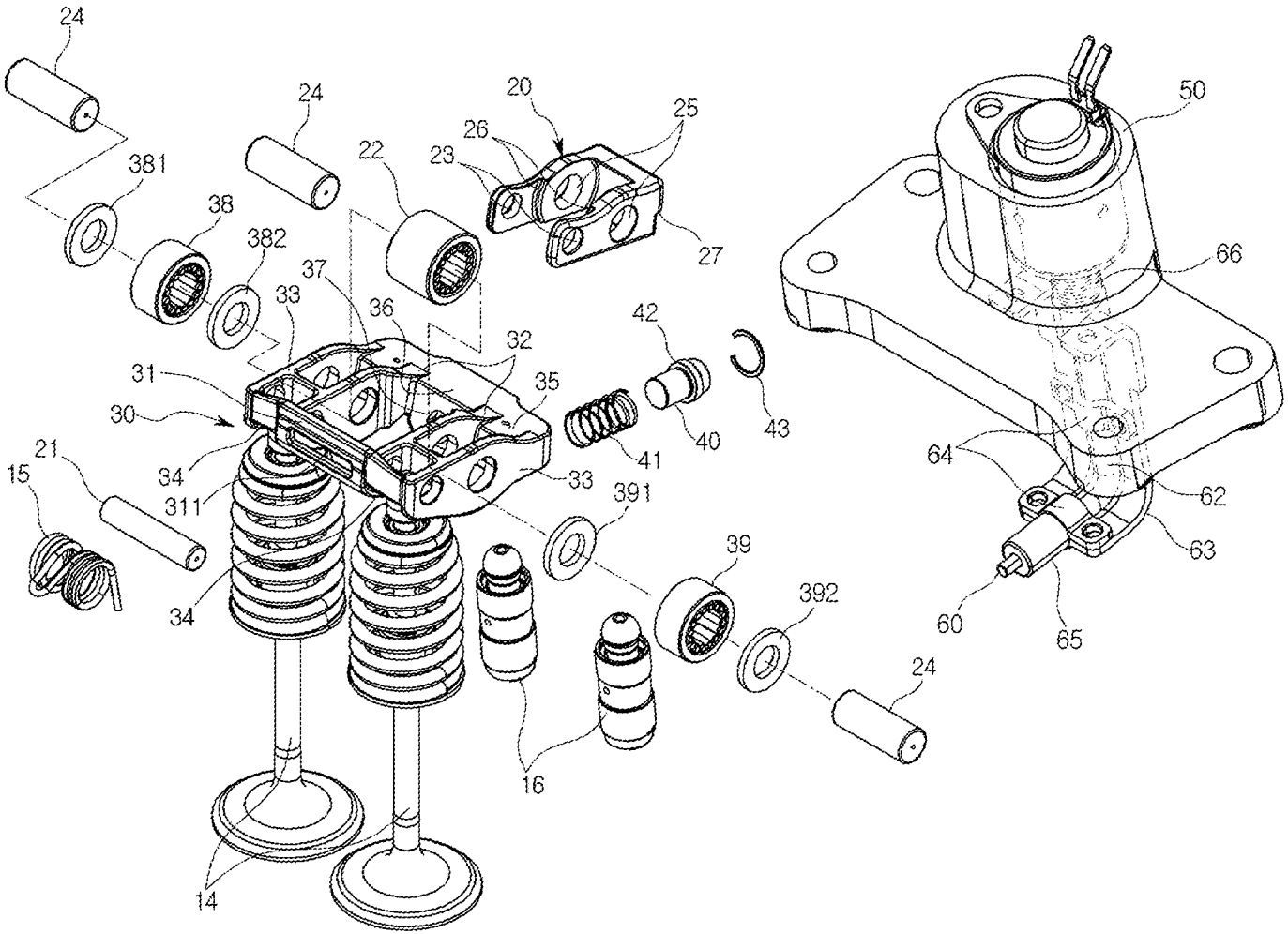
FIG. 2 is a partially exploded perspective view of the variable valve lift actuator of the engine shown in FIG. 1.
Figure 3:
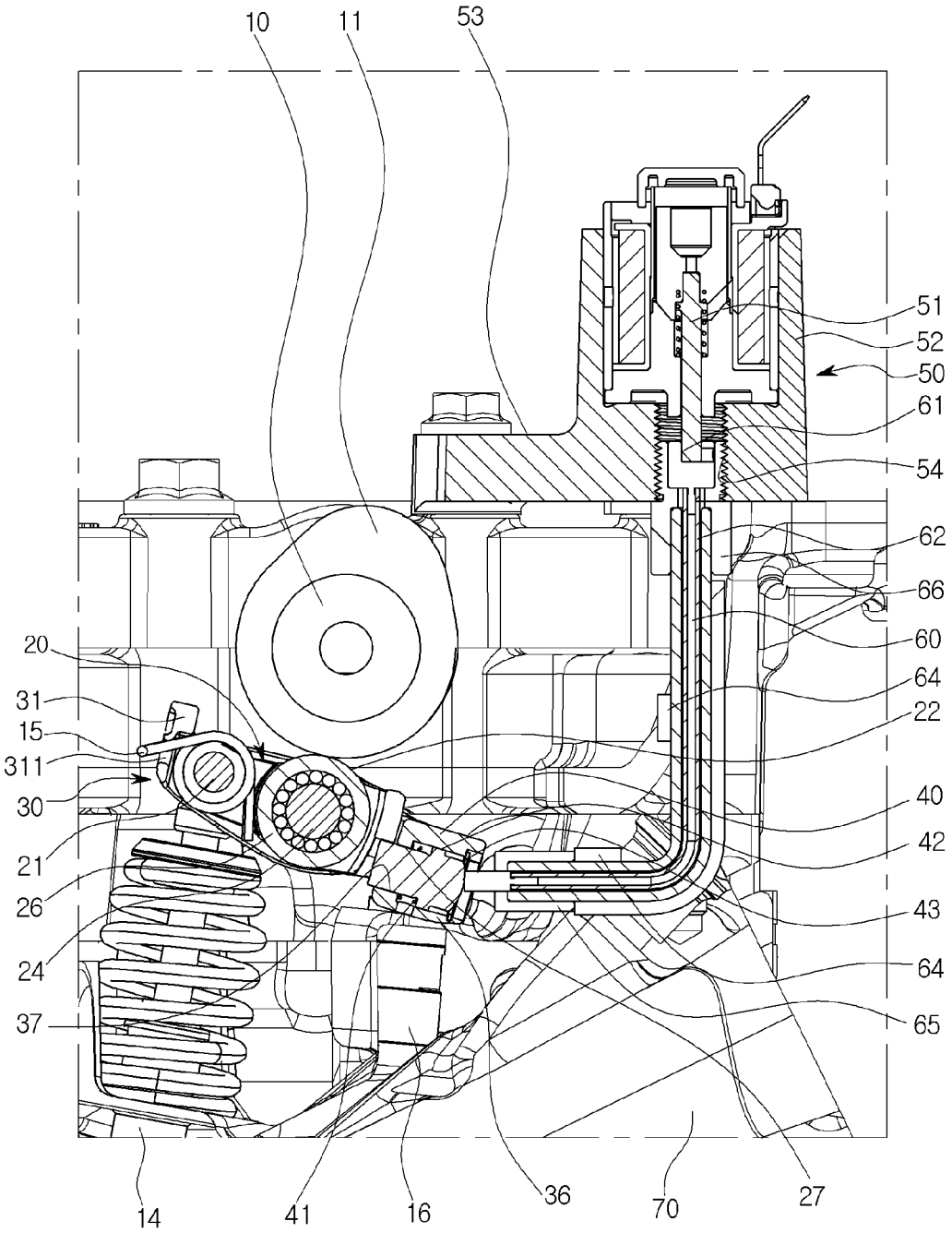
FIG. 3 is a partially enlarged sectional view of a head provided with the variable valve lift actuator of the engine shown in FIG. 1.

FIG. 1 is a perspective view of a variable valve lift actuator of an engine according to a first embodiment of the present invention, FIG. 2 is a partially exploded perspective view of the variable valve lift actuator of the engine shown in FIG. 1 and FIG. 3 is a partially enlarged sectional view of a head provided with the variable valve lift actuator of the engine shown in FIG. 1.

Hereinafter, terms indicating directions such as 'left', 'right', 'forward', 'rearward', 'upward' and 'downward' are defined as indicating respective directions based on the state shown in the drawings.

As shown in FIGS. 1 and 2, the variable valve lift actuator of the engine according to the first embodiment of the present invention includes a first body 20 that rotates within a predetermined angular range by a rotational movement of a high-speed cam 11 coupled to a camshaft 10, a second body 30 that opens or closes a valve 14 based on the connection state of the first body 20, a latching pin 40 that projects toward a front of the first body 20 or retracts from the front of the first body 20 to connect or disconnect the first and second bodies 20 and 30, and a drive module 50 connected to the latching pin 40 through a wire 60 to drive the latching pin 40 such that the latching pin 40 can project or retract.

As shown in FIG. 3, a number of the variable valve lift actuators of the engine may correspond to a number of cylinders of the engine, and the variable valve lift actuator of the engine may be installed on a cylinder head 70 while being tilted at a predetermined angle.

In addition, the variable valve lift actuator of the engine according to the first embodiment of the present invention may further include a return spring 15 installed on a rotary shaft 21, on which the first body 20 rotates, to provide a restoring force to return the return spring 15 rotated by the cam 11 to its original position.

The return spring 15 may include a torsion spring having a center portion protruding forward.

For example, the center portion of the return spring 15 is inserted into an insertion hole 311 formed in a front wall 31 of the second body 30 to be described below, and protrudes forward such that the return spring 15 cannot move up and down and both ends of the return spring 15 can be supported by support steps 26 formed on both side walls of the first body 20, which will be described below.

As described above, according to the present invention, since the return spring for returning the first body to the original position is provided on the rotation shaft of the first body, it is not necessary to perform the head machining work of the first body, which is required in the related art due to a compression spring installed to make contact with a lower portion of the first body.

Accordingly, the present invention can improve the workability by eliminating the head machining work of the first body, which is required in the related art due to the application of the compression spring, and can simplify the structure of the variable valve lift actuator of the engine, so that the present invention can be easily applied to an actual engine of the vehicle.

The first body 20 may include both side walls and a rear wall such that, when viewed from the top, the front of the first body 20 is open to have a substantially U-shaped section.

A rotary roller 22, which is rotated by the cam 11, may be provided inside the first body 20 to minimize friction upon contact with the cam 11.

Coupling holes 23 may be formed at front ends of both side walls of the first body 20, respectively, so as to engage with the rotary shaft 21 and mounting holes 25, in which a roller shaft 24 of the rotary roller 22 is installed, may be formed at center portions of the both side walls of the first body 20.

The rotary shaft 21 is inserted through both side walls of the first body 20 and both side walls of the second body 30 and the return spring 15 may be installed on the outer peripheral surface of the center portion of the rotary shaft 21.

Accordingly, the first body 20 can rotate about the rotation rotary shaft 21.

The roller shaft 24 is inserted through a pair of mounting holes 25 formed on both side walls of the first body 20 and a bearing may be provided between the roller shaft 24 and the rotary roller 22 to allow the rotary roller 22 to smoothly rotate.

The roller shaft 24 may extend by a length corresponding to the distance between the pair of outer walls 33 of the second body 30 to be described below or may be divided into a plurality of roller shafts 24 as shown in FIG. 2.

Meanwhile, the support steps 26 may be provided on inner surfaces of both side walls of the first body 20 to support both ends of the return spring 15.

In addition, a latching plate 27 latched with the latching pin 40 may be provided on a rear wall of the first body 20 such that the first and second bodies 20 and 30 can be integrally rotated by the rotation of the cam 11 upon the forward movement of the latching pin 40.

The second body 30 may include a front wall 31 and both side walls such that the second body 30 is disposed on the front surface and both side surfaces of the first body 20. When viewed from the top, the rear surface of the second body 30 is open so that the second body 30 has a substantially U-shape.

Both side walls of the second body 30 may include an inner wall 32 and an outer wall 33.

Pressing pieces 34 may be provided on both sides of the front wall 31 of the second body 30. The pressing pieces 34 make contact with an upper end of the valve 14 between the inner wall 32 and the outer wall 33 to press the valve 14 such that the valve 14 moves up and down.

The pressing piece 34 may have a semi-cylindrical shape having a sectional shape convex downward so as to smoothly press the upper end of the valve 14 when the second body 30 is rotated by the rotation of the cam 11.

Thus, the pressing piece 34 can open or close the valve 14 by pushing down the upper end of the valve 14 such that the valve 14 moves up and down according to the rotational movement of the second body 30.

Therefore, according to the present invention, the semi-cylindrical pressing pieces are provided on both sides of the second body and make contact with the upper end of the valve so that a contact area can be increased, thereby improving the operating characteristics of the valve.

A rear end of the second body 30 can be supported by a pivot support mechanism 16.

In the present embodiment, the pivot support mechanism 16 may be provided as a hydraulic lash adjuster that automatically adjusts the clearance of the valve 14 using hydraulic pressure.

For example, the hydraulic lash adjuster may be contracted and expanded according to a change in oil pressure in a state in which the oil is constantly supplied to the inside of the hydraulic lash adjuster, thereby finely adjusting the clearance of the valve 14.

That is, the hydraulic lash adjuster maintains a contracted state by allowing a check valve provided inside the hydraulic lash adjuster to be maintained in a closed state when the oil pressure is lower than a preset pressure.

On the other hand, when the oil pressure exceeds the preset pressure, the check valve provided inside the hydraulic lash adjuster is open so that an oil path is open. Thus, the hydraulic lash adjuster is expanded to move the rear end of the second body 30 in the forward direction, thereby adjusting the clearance of the valve 14.

To this end, support plates 35 may be provided on outer portions of the pair of inner side walls 32 of the second body 30, respectively, in contact with the upper end of the pivot support mechanism 16.

Accordingly, the second body 30 can rotate about the pivot support mechanism 16.

Meanwhile, a mounting portion 36 is provided at a rear end of the second body 30 and the latching pin 40 is installed in the mounting portion 36 such that the latching pin 40 can slidably move in the forward direction. A movement space 37 may be formed at the center portion of the mounting portion 36.

The mounting portion 36 may be provided between rear ends of the pair of inner walls 32 of the second body 30.

In addition, first and second rollers 38 and 39, which are rotated in contact with the low-speed cam 13 to be described below with reference to the configuration of the second embodiment shown in FIG. 6, may be installed on both sides of the second body 30.

To this end, outer side walls 33 formed on both sides of the second body 30 extend by a length corresponding to a length of the inner side wall 32 and an opening and a support plate 35 may be provided between each of the outer side walls 33 and the inner side wall.

Therefore, the first and second rollers 38 and 39 can be rotatably installed on the roller shaft 24 which is coupled to the inner side wall 32 and the outer side wall 33 of the second body 30 formed at both sides of the second body 30.

In addition, the first and second rollers 38 and 39 are provided at central portions thereof with bearings, respectively, and two pairs of roller bushes 381, 382, 391, and 392 in the form of disk rings may be installed on both sides of the first and second rollers 38 and 39 to prevent the bearings from being separated when the first and second rollers 38 and 39 are rotated.

The latching pin 40 is connected to the drive pin 51 of the drive module 50 via the wire 60 and can move back and forth as the drive pin 51 moves up and down.

In addition, a latching spring 41 may be installed on an outer circumferential surface of the latching pin 40 to provide a restoring force to the latching pin 40. The latching spring 41 may be disposed inside the movement space 37 formed in the mounting portion 36 of the second body 30.

The latching pin 40 may have a cylindrical structure having a substantially circular or elliptical sectional shape, and a front end of the wire 60 may come into contact with a rear end of the latching pin 40.

An annular support portion 42 for supporting a rear end of the latching spring 41 is formed on an outer peripheral surface of the central portion of the latching pin 40 and the moving distance of the annular support portion 42 in the rearward direction may be limited by a snap ring 43 installed in the movement space 37 formed inside the second body 30.

The drive module 50 may be provided as a solenoid which operates to move the drive pin 51 up and down in accordance with a control signal from an electronic control unit (not shown) for controlling the operation of the engine.

For example, when the power is applied according to the control signal in a state in which a front end of the drive pin 51 is coupled to a rear end of the wire 60 and a front end of the wire 60 is in contact with the latching pin 40, the drive module 50 generates a magnetic field from a coil wound inside the drive module 50 to move up the drive pin 51. Thus, the latching pin 40 can move rearward together with the wire 60 fitted into the drive pin 51. Accordingly, the connection between the first body 20 and the second body 30 can be released.

In addition, as the power is turned off according to the control signal, the drive module 50 moves the drive pin 51 downward as the magnetic field generated therein is removed. Then, the latching pin 40 can move forward and return to its original position while elastically deforming the latching spring 41. Thus, the latching pin 40 moves forward, so that the first body 20 and the second body 30 can be connected.

The drive module 50 constructed as described above is installed inside the housing 52 having a cylindrical shape and a flange portion 53 having a substantially rectangular plate shape may be provided at a lower end of the housing 52 such that the housing 52 can be installed on the cylinder head 70.

A plurality of fastening holes may be formed in the flange portion 53 so that a plurality of fastening bolts (not shown) may be fastened to the cylinder head 70 by passing through the fastening holes of the flange portions 53.

The wire 60 may be formed of a metal material having rigidity so as to transfer a driving force for moving the latching pin 40 back and forth according to the vertical movement of the drive pin 51.

In addition, a coupling groove 61, into which the drive pin 51 is press-fitted, is formed at a rear end of the wire 60, that is, an upper end of the wire 60 when viewed in FIG. 3. A front end of the wire 60, that is, a lower end of the wire 60 when viewed in FIG. 3 may be bent forward to transfer the driving force of the drive pin 51 acting in the vertical direction to the latching pin 40 to move the latching pin 40 back and forth.

The wire 60 may be installed inside a protective tube 62 provided between the housing 52 of the drive module 50 and a rear end of the latching pin 40.

Although it is described in the present embodiment that the driving force that causes the latching pin 40 to move back and forth is transferred by using the wire 60 in accordance with the vertical movement of the drive pin 51, the present invention is not limited thereto.

That is, the present invention can be modified to transfer the driving force to the latching pin by applying a connecting member having various shapes and structures such as a spring as well as a wire.

A space is formed in the protective tube 62 for installing the wire 60 and a guide 63 for guiding the protective tube 62 may be provided outside the protective tube 62. The guide 63 may be provided with one or more brackets 64 for fixing the protective tube 62 inside the cylinder head 70.

The guide 63 has a substantially rectangular plate shape and a coupling space corresponding to an external shape of the protective tube 62 is formed at the center of the guide 63. The upper end and the lower end of the guide 63 may be bent forward to make close contact with a lower surface of the housing 52 and an upper surface the inner space of the cylinder head 70, respectively.

For example, the brackets 64 are provided at the center and the lower end of the guide 63, respectively, and fastening holes into which fixing bolts (not shown) are inserted through the brackets 64 may be formed in both sides of the bracket 64.

Meanwhile, an installation space 54 is formed in the housing to install the drive pin 51, the wire 60 and the protective tube 62. First and second coupling members 65 and 66 coupled to the second body 30 and the housing 52 may be provided at front and rear ends of the protective tube 62, respectively.

The first coupling member 65 has a substantially cylindrical shape having a rear surface being opened so that a front end of the protective tube 62 is coupled with the first coupling member 65 and the first coupling member 65 can be coupled to a rear end of the second body 30.

The second coupling member 66 has a substantially cylindrical shape having a lower end being opened so that a rear end of the protective tube 62 can be coupled to the second coupling member 66 and the second coupling member 66 can be coupled to the installation space 54 of the housing 52.

An outer peripheral surface of an upper end of the second coupling member 66 and an inner peripheral surface of the installation space 54 formed in the housing 52 may be formed with threads so that the protective tube 62 can be coupled to the housing 52.

Such a protective tube 62 can be formed of a material having flexibility and shape-fixability, which is a property for maintaining a shape constantly, for facilitating the installation work for the wire 60 and the protective tube 62.

As described above, according to the present invention, the drive module for causing the latching pin to project and retract is provided on the cylinder head, and the driving force of the drive module can be transferred to the latching pin using a connecting member provided inside the protective tube.

Accordingly, the present invention can connect or disconnect the first body and the second body by transferring the driving force to the latching pin through the connecting member to project and retract the latching pin.

That is, according to the present invention, the drive pin and the latching pin are configured in a push load type for projecting and retracting the latching pin by applying the connecting member between the drive pin and the latching pin, thereby reinforcing the strength of the latching pin and the drive pin.

In particular, according to the present invention, since the drive module is provided on the cylinder head, the mounting space can be minimized when mounted on the cylinder head, thereby minimizing the restriction in the structure of the cylinder head.

Meanwhile, although it has been described in the present embodiment that the drive module for projecting and retracting the latching pin is provided as a solenoid, the present invention is not limited thereto, and various types of operating units, such as a motor operated by receiving the power, as well as the solenoid can be used according to applications thereof.

Hereinafter, an operation method of the variable valve lift actuator of the engine according to the first embodiment of the present invention will be described in detail with reference to FIGS. 4 and 5.

Figure 4:
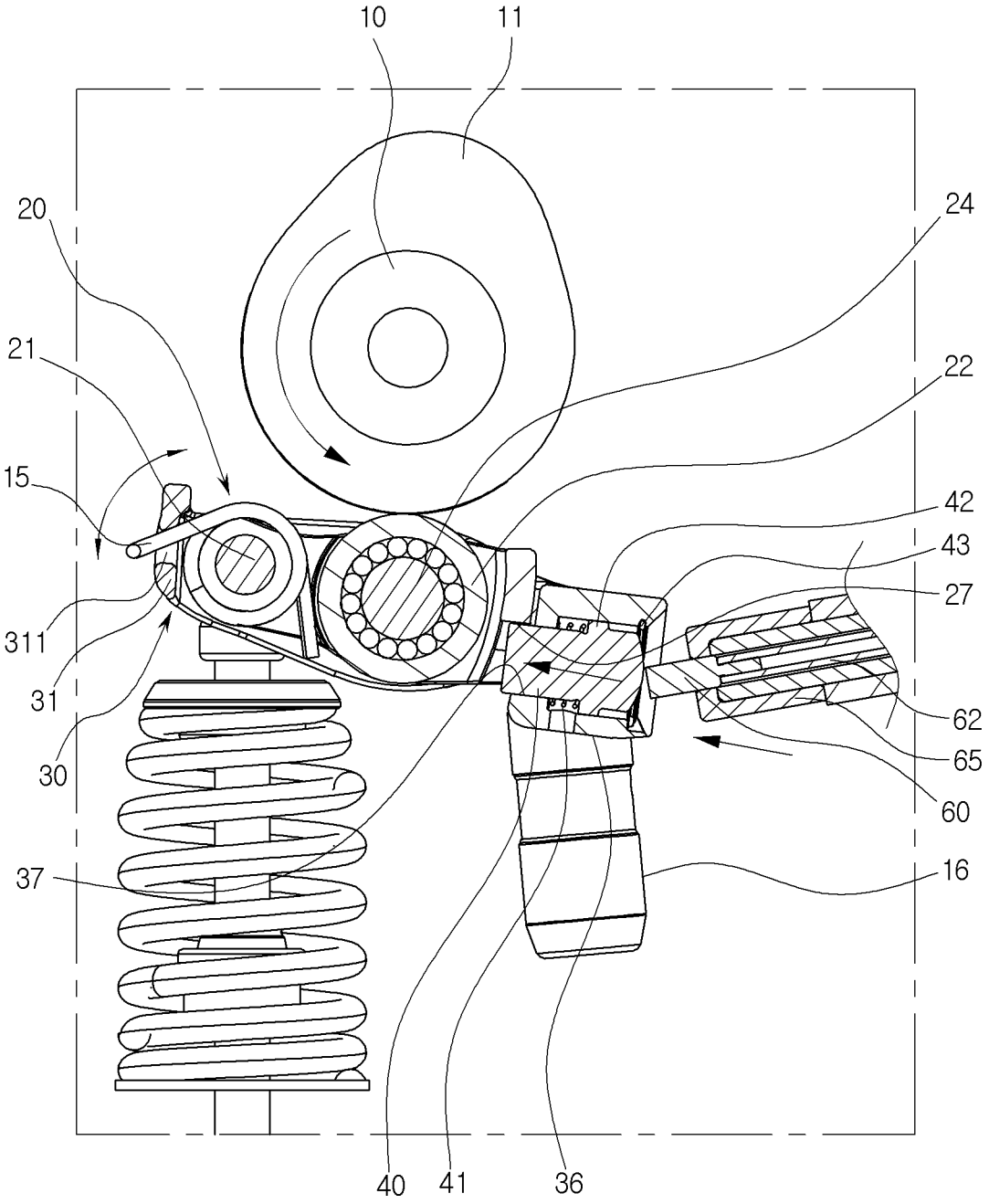
FIGS. 4 and 5 are views showing the operational state of the variable valve lift actuator of the engine according to a first embodiment of the present invention.
Figure 5:
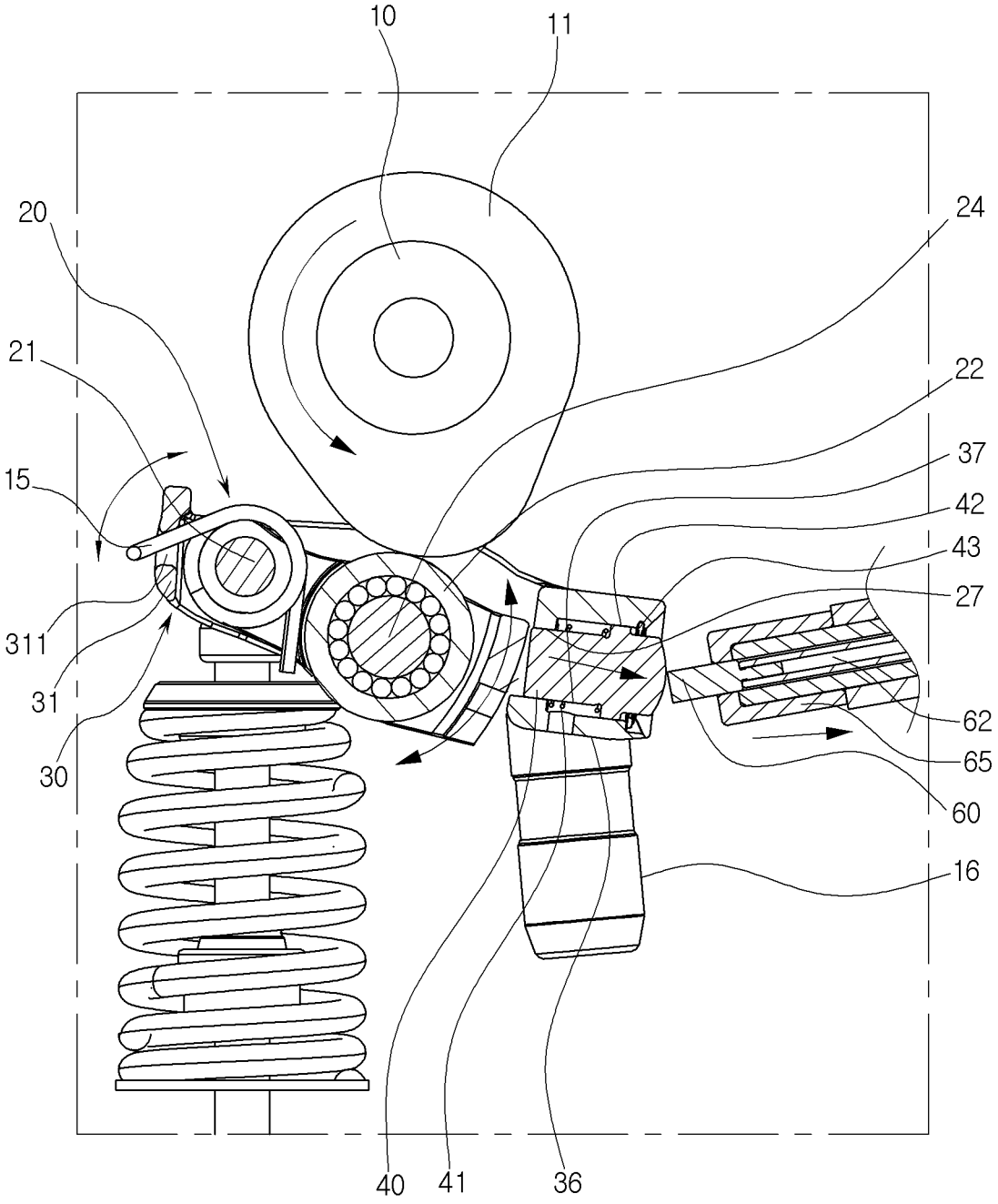

FIGS. 4 and 5 are views showing the operational state of the variable valve lift actuator of the engine according to the first embodiment of the present invention.

FIG. 4 shows the operational state in which the valve is opened and closed by the rotational movement of the cam in the variable valve lift actuator of the engine, and FIG. 5 shows the operational state for an idle control operation of the valve.

As shown in FIG. 4, the variable valve lift actuator of the engine according to the first embodiment of the present invention turns off the power supplied to the drive module 50 when the valve 14 is opened and closed by the rotational motion of the cam 11. Then, as the drive pin 51 moves downward, the wire 60 moves forward, and the latching pin 40 is pressed by the wire 60 and moves forward.

As the front end of the latching pin 40 protrudes forward through the mounting portion 36 of the second body 30 and is latched with the latching plate 27 formed on the rear wall of the first body 20, the first body 20 and the second body 30 are connected to each other.

Therefore, in the variable valve lift actuator of the engine according to the first embodiment of the present invention, the first and second bodies 20 and 30 are rotated in a predetermined angular range by the rotational movement of the cam 11 to move the valve 14 up and down, so that the valve 14 can be opened or closed.

The center portion of the return spring 15 installed on the rotary shaft 21 is supported so as not to move up and down while being inserted into the insertion hole 311 formed in the front wall 31 of the second body 30, and both ends of the return spring 15 are supported by the support steps 26 formed on both side walls of the first body 20.

Thus, the return spring 15 can return the first and second bodies 20 and 30, which have been rotated by the cam 11, to their original positions by providing the restoring force to the first body 20.

Meanwhile, when the idle control operation of the valve 14 is implemented in order to deactivate some cylinders in the variable valve lift actuator of the engine according to the first embodiment of the present invention, the power is applied to the drive module 50 according to the control signal of the electronic control unit.

Thus, as shown in FIG. 5, the drive pin 51 of the drive module 50 moves upward, so that the wire 60 moves rearward, and the latching pin 40 moves rearward to the original position thereof.

Since the moving distance in the rearward direction of the latching pin 40 is limited because the annular support portion 42 is latched with the snap ring 43 provided in the movement space 37, the latching pin 40 is prevented from being separated from the movement space 37.

As described above, the latching pin 40 is accommodated in the mounting portion 36 of the second body 30 while moving rearward, so that the first body 20 and the second body 30 are separated from each other.

Thus, the front end portion and the rear end portion of the second body 30 are fixed in contact with the upper end of the valve 14 and the upper end of the pivot support mechanism 16, respectively.

Therefore, in the variable valve lift actuator of the engine according to the first embodiment of the present invention, the second body 30, which is in contact with the upper end of the valve 14, is fixed even when the cam 11 rotates, so that the idle control operation of the valve 14 can be implemented.

As described above, according to the present invention, the opening/closing operation and the idle control operation of the valve can be implemented by selectively connecting or disconnecting the first body and the second body by using the latching pin, so that some cylinders can be deactivated in the low-speed and low-load state.

Accordingly, the present invention can minimize the amount of fuel consumption in the low-speed and low-load state of the engine, thereby improving the efficiency of the engine and maximizing the fuel efficiency of the vehicle.

Through the above-described process, the present invention can perform the idle control operation of the valve that deactivates some cylinders according to the operating condition of the engine.

Further, according to the present invention, the pivot point of the first and second bodies is moved to the side of the valve to reduce the moment of inertia, and the valve is moved up and down by directly contacting the valve with the rotary shaft, thereby improving the dynamic characteristics and operational performance of the valve.

Meanwhile, although the first embodiment has been described in relation to the idle control operation of the valve, the present invention is not limited thereto.

That is, according to the present invention, the idle control operation and the two-stage control operation of the valve can be implemented with the same variable valve lift actuator according to the configuration of the cam by changing only the configuration of the cam.

Embodiment 2

Hereinafter, the configuration of a variable valve lift actuator of an engine according to a second embodiment of the present invention will be described in detail with reference to FIG. 6.

Figure 6:
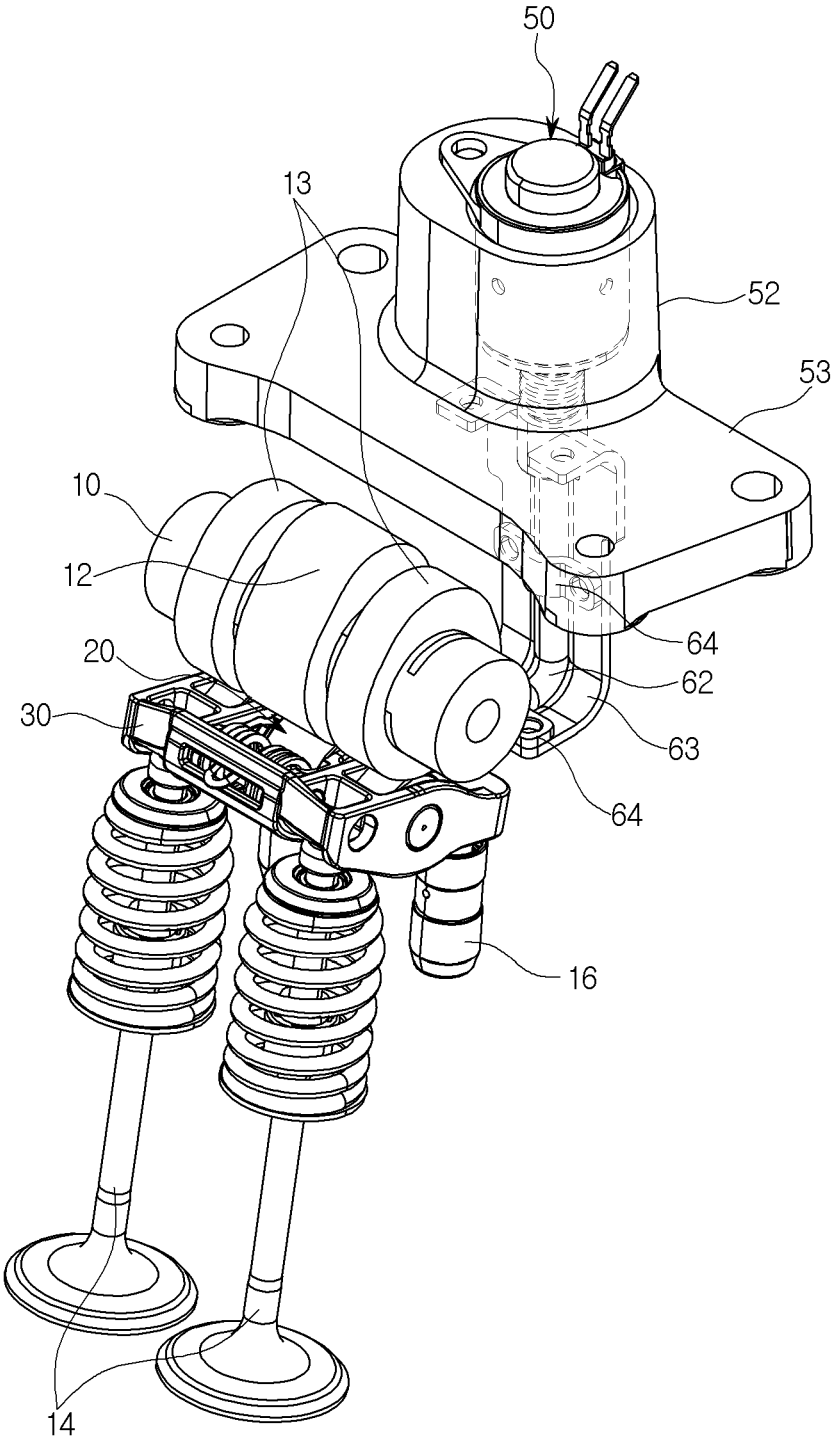
FIG. 6 is a perspective view of a variable valve lift actuator of an engine according to a second embodiment of the present invention.

FIG. 6 is a perspective view of the variable valve lift actuator of the engine according to the second embodiment of the present invention.

As shown in FIG. 6, the variable valve lift actuator according to the second embodiment of the present invention is similar to that of the first embodiment except that some elements are added to variably control the lift amount of the valve in two-stages of a high-speed mode and a low-speed mode.

That is, the camshaft 10 may be provided with a high-speed cam 12 for controlling the lift amount of the valve 14 to the maximum in the high-speed and high-load state of the engine and a low-speed cam 13 for controlling the lift amount of the valve 14 to the minimum in the low-speed and low-load state of the engine.

The high-speed cam 12 can be manufactured in a shape corresponding to the cam 11 of the first embodiment.

A pair of low-speed cams 13 may be provided in contact with both sides of the second body 30 and installed on both sides of the high-speed cam 12, respectively.

The low-speed cam 13 is manufactured to have a maximum diameter smaller than a maximum diameter of the high-speed cam 12.

The rotary roller 22 coupled to the roller shaft 24 is installed in contact with the high-speed cam 12, and the first and second rollers 38 and 39 are installed in contact with the pair of low-speed cams 13, respectively.

Next, a method of operating the variable valve lift actuator according to the second embodiment of the present invention will be described in detail with reference to FIGS. 7 and 8.

Figure 7:
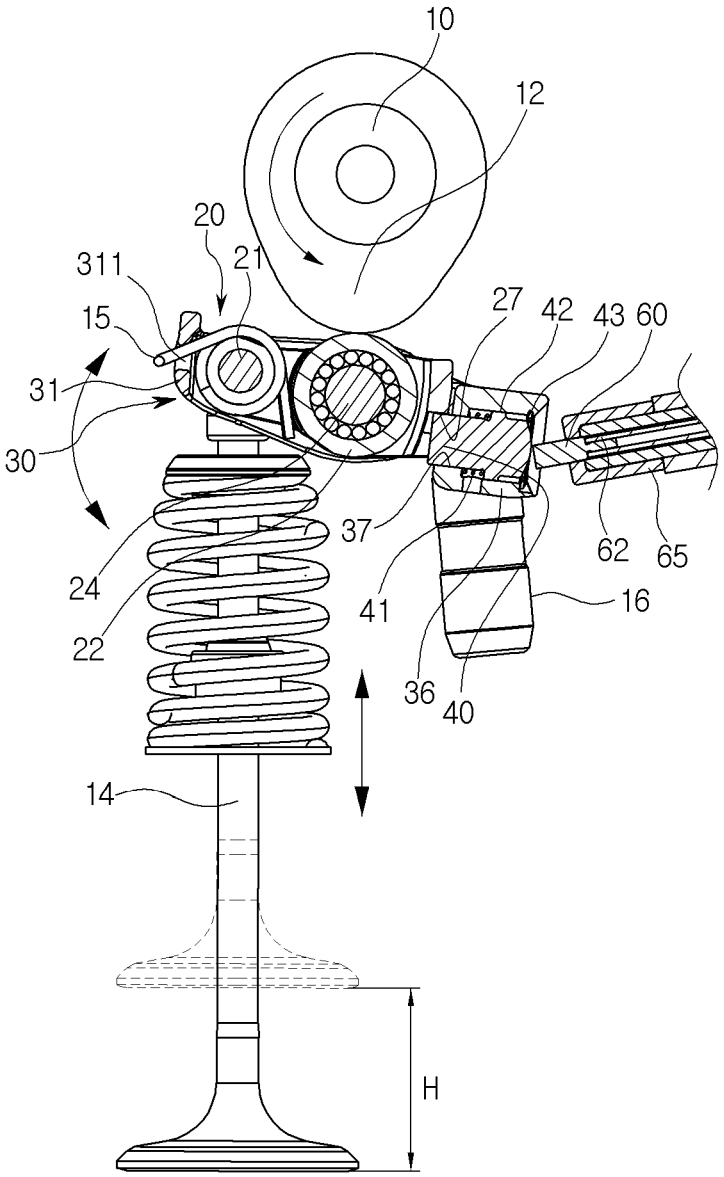
FIGS. 7 and 8 are views showing the operational state of the variable valve lift actuator of the engine according to the second embodiment of the present invention.
Figure 8:
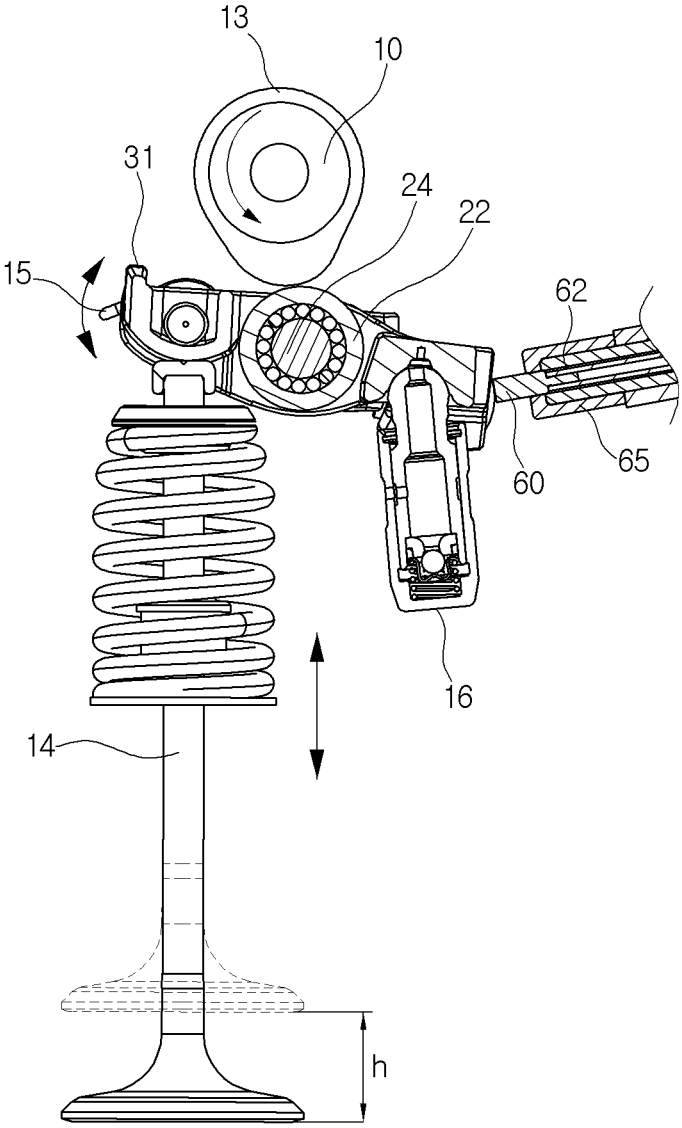

FIGS. 7 and 8 are views showing the operational state of the variable valve lift actuator of the engine according to the second embodiment of the present invention.

FIG. 7 shows the operational state of the variable valve lift actuator of the engine in the high-speed and high-load mode of the engine and FIG. 8 shows the operational state of the variable valve lift actuator of the engine in the low-speed and low-load mode.

In the variable valve lift actuator of the engine according to the second embodiment of the present invention, as shown in FIG. 7, when the power applied to the drive module 50 is cut off in the high-speed and high-load state of the engine, the drive pin 51 moves downward and the latching pin 40 connected to the drive pin 51 through the wire 60 moves forward by the restoring force of the latching spring 41.

Then, the front end of the first latching pin 40 projects forward through the mounting portion 36 of the second body 30 and is latched with the latching plate 27 formed on the rear wall of the first body 20, so that the first body 20 and the second body 30 are connected to each other.

At this time, the first body 20 comes into contact with the high-speed cam 12 installed on the camshaft 10 so that the first body 20 rotates together with the second body 30.

Accordingly, in the variable valve actuator of the engine according to the second embodiment of the present invention, the first and second bodies 20 and 30 are rotated in a predetermined angular range by the rotational movement of the high-speed cam 12 to move the valve 14 up and down, so that the valve 14 can be opened and closed.

Since the lift amount H of the valve 14 by the high-speed cam 12 becomes larger than the lift amount h (see FIG. 8) of the valve 14 by the low-speed cam 13, the flow rate of the air supplied to the cylinder of the engine may be increased.

As shown in FIG. 8, when the power is applied to the drive module 50 in the low-speed and low-load state of the engine, the variable valve lift actuator of the engine according to the second embodiment of the present invention moves the drive pin 51 upward and moves the latching pin 40, which is connected to the drive pin 51 through the wire 60, rearward.

Thus, the variable valve lift actuator of the engine maintains the latching pin 40 in a state of being accommodated in the mounting portion 36 of the second body 30 so that the first body 20 and the second body 30 are separated from each other.

At this time, the first and second rollers 38 and 39 provided on the second body 30 rotate while making contact with a pair of low-speed cams 13 provided on the camshaft 10.

Then, the second body 30 rotates about the pivot support mechanism 16 by the rotation of the low-speed cam 13, thereby opening or closing the valve 14.

At this time, as the lift amount h of the valve 14 by the low-speed cam 13 becomes smaller than the lift amount H (see FIG. 7) of the valve 14 by the high-speed cam 12, the flow rate of air supplied to the cylinder of the engine is decreased.

As described above, according to the present invention, the latching pin is projected and retracted by using the connecting member connected to the drive pin to connect or disconnect the first body and the second body, so that the lift amount of the valve can be controlled in two-stages of the high-speed mode and the low-speed mode by the rotational movement of the high-speed cam or the low-speed cam.

As described above, according to the present invention, the idle control operation and the two-stage control operation of the valve can be implemented with the same variable valve lift actuator according to the configuration of the cam by changing only the configuration of the cam.

Although embodiments of the present invention made by the present inventors have been described, the present invention is not limited to the above embodiments, and various changes can be made without departing from the scope of the present invention.

That is, according to the present invention, openings may be formed on both sides of the second body instead of the pressing pieces, and contact surfaces are formed at both ends of the first rotary shaft such that an upper end of the valve makes contact with the contact surfaces. In this case, the contact area can be increased, so that the operational characteristics of the valve can be improved.

The present invention can be applied to a variable valve lift actuator of an engine that performs an idle control operation of a valve for deactivating some cylinders and a two-stage variable control operation of a high speed mode and a low speed mode in accordance with operating conditions of the engine.

What is claimed is:

1. A variable valve lift actuator of an engine, the variable valve lift actuator comprising:

a first body that rotates within a predetermined angular range by a rotational movement of a high-speed cam coupled to a camshaft;

a second body selectively connected to or disconnected from the first body via a latching pin configured to selectively project to or retract from the first body by passing through the second body, wherein the second body is rotated by the rotational movement of the high-speed cam when connected to the first body in a high-speed mode, and the second body is rotated by a rotational movement of dual low-speed cams respectively provided at first and second sides of the high-speed cam when disconnected from the first body in a low-speed mode, thereby adjusting a lift amount of a valve;

a drive module including a drive pin configured to move up and down;

a connecting member for connecting the drive pin to the latching pin, wherein the connecting member is configured to retract and project the latching pin as the drive pin moves up and down, respectively;

a rotary shaft disposed above the valve; and a return spring installed on the rotary shaft, wherein the first body is rotated about the rotary shaft by the high-speed cam and the return spring provides the first body with a restoring force, wherein the lift amount of the valve is variably controlled between the high-speed mode and the low-speed mode according to operating conditions of the engine, wherein the drive module is installed on a cylinder head of a vehicle, and wherein the connecting member is formed of a flexible material configured to convert and transmit a vertical driving force from the drive pin to a horizontal driving force on the latching pin.

2. The variable valve lift actuator of claim 1, wherein the drive module is installed inside a cylindrical housing, a flange portion having a rectangular plate shape is formed on a lower end of the housing and installed on the cylinder head of the vehicle, and the connecting member is installed inside a protective tube formed of a flexible material.

3. The variable valve lift actuator of claim 2, wherein a first coupling member couples a front end of the protective tube to the second body and a second coupling member couples a rear end of the protective tube to the housing, and threads formed on an outer peripheral surface of the second coupling member correspond to threads formed on an inner peripheral surface of a coupling space formed in the housing.

4. The variable valve lift actuator of claim 3, wherein the second body includes a front wall, an inner wall and an outer wall formed at a front surface and first and second side surfaces of the second body such that the front wall, the inner wall and the outer wall are disposed at a front surface and first and second side surfaces of the first body, the second body includes a support plate installed between the inner wall and a rear end of the outer wall of the second body so as to be supported by making contact with an upper end of a pivot support mechanism, a center portion of the return spring protrudes so as to be inserted into and supported by an insertion hole formed in the front wall of the second body, first and second ends of the return spring are supported by supporting protrusions, the dual low-speed cams respectively contact first and second rollers installed on the second body, the high-speed cam contacts a rotary roller installed on the first body, a latching plate, which receives the latching pin, is provided at a rear end of the first body so as to enable the first and second bodies to rotate integrally according to rotation of the high-speed cam when the latching pin is projected, the second body is provided with a mounting portion through which the latching pin is slidably installed, and a movement space through which the latching pin is moved is formed in the mounting portion.

5. The variable valve lift actuator of claim 2, wherein a guide is provided outside the protective tube, the protective tube is fixed inside the cylinder head via at least one bracket provided to the guide, a coupling space corresponding to an outer shape of the protective tube is formed at a center of the guide, and an upper end portion of the guide extends vertically towards the housing and a lower end portion of the guide is bent and extends horizontally towards the second body.

6. The variable valve lift actuator of claim 5, wherein the second body includes a front wall, an inner wall and an outer wall formed at a front surface and first and second side surfaces of the second body such that the front wall, the inner wall and the outer wall are disposed at a front surface and first and second side surfaces of the first body, the second body includes a support plate installed between the inner wall and a rear end of the outer wall of the second body so as to be supported by making contact with an upper end of a pivot support mechanism, a center portion of the return spring protrudes so as to be inserted into and supported by an insertion hole formed in the front wall of the second body, first and second ends of the return spring are supported by supporting protrusions, the dual low-speed cams respectively contact first and second rollers installed on the second body, the high-speed cam contacts a rotary roller installed on the first body, a latching plate, which receives the latching pin, is provided at a rear end of the first body so as to enable the first and second bodies to rotate integrally according to rotation of the high-speed cam when the latching pin is projected, the second body is provided with a mounting portion through which the latching pin is slidably installed, and a movement space through which the latching pin is moved is formed in the mounting portion.

7. The variable valve lift actuator of claim 2, wherein the second body includes a front wall, an inner wall and an outer wall formed at a front surface and first and second side surfaces of the second body such that the front wall, the inner wall and the outer wall are disposed at a front surface and first and second side surfaces of the first body, the second body includes a support plate installed between the inner wall and a rear end of the outer wall of the second body so as to be supported by making contact with an upper end of a pivot support mechanism, a center portion of the return spring protrudes so as to be inserted into and supported by an insertion hole formed in the front wall of the second body, first and second ends of the return spring are supported by supporting protrusions, the dual low-speed cams respectively contact first and second rollers installed on the second body, the high-speed cam contacts a rotary roller installed on the first body to, a latching plate, which receives the latching pin, is provided at a rear end of the first body so as to enable the first and second bodies to rotate integrally according to rotation of the high-speed cam when the latching pin is projected, the second body is provided with a mounting portion through which the latching pin is slidably installed, and a movement space through which the latching pin is moved is formed in the mounting portion.

8. The variable valve lift actuator of claim 1, wherein the second body includes a front wall, an inner wall and an outer wall formed at a front surface and first and second side surfaces of the second body such that the front wall, the inner wall and the outer wall are disposed at a front surface and first and second side surfaces of the first body, the second body includes a support plate installed between the inner wall and a rear end of the outer wall of the second body so as to be supported by making contact with an upper end of a pivot support mechanism, a center portion of the return spring protrudes so as to be inserted into and supported by an insertion hole formed in the front wall of the second body, first and second ends of the return spring are supported by supporting protrusions, the dual low-speed cams respectively contact first and second rollers installed on the second body, the high-speed cam contacts a rotary roller installed on the first body, a latching plate, which receives the latching pin, is provided at a rear end of the first body so as to enable the first and second bodies to rotate integrally according to rotation of the high-speed cam when the latching pin is projected, the second body is provided with a mounting portion through which the latching pin is slidably installed, and a movement space through which the latching pin is moved is formed in the mounting portion.

9. A variable valve lift actuator of an engine, the variable valve lift actuator comprising:

a first body that rotates within a predetermined angular range by a rotational movement of a high-speed cam coupled to a camshaft;

a second body selectively connected to or disconnected from the first body via a latching pin configured to selectively project to or retract from the first body by passing through the second body, wherein the second body is rotated by the rotational movement of the high-speed cam when connected to the first body, thereby adjusting a lift amount of a valve;

a drive module including a drive pin configured to move up and down;

a connecting member for connecting the drive pin to the latching pin, wherein the connecting member is configured to retract and project the latching pin as the drive pin moves up and down, respectively;

a latching spring disposed on the latching pin, wherein the latching spring is configured to provide a restoring force to the latching pin;

a rotary shaft disposed above the valve; and a return spring installed on the rotary shaft, wherein the first body is rotated about the rotary shaft, wherein the first body is rotated about the rotary shaft by the high-speed cam and the return spring provides the first body with a restoring force, wherein an idle control operation of the valve, in which cylinders are deactivated by operating the latching pin to disconnect the first body and the second body in a low-speed and low-load state of the engine, is performed, wherein the drive module is installed on a cylinder head of a vehicle, and wherein the connecting member is formed of a flexible material configured to convert and transmit a vertical driving force from the drive pin to a horizontal driving force on the latching pin.

* * * * *